US005389150A

United States Patent [19]

Baum et al.

[11] Patent Number: 5,389,150

[45] Date of Patent: Feb. 14, 1995

[54] COATING HOPPER INSERTS

[75] Inventors: William Baum, Rochester; Douglas R. Korn, Hilton, both of N.Y.

[73] Assignee: Eastman Kodak Company, Rochester, N.Y.

[21] Appl. No.: 37,970

[22] Filed: Mar. 26, 1993

[51] Int. Cl.[6] ..... B05C 11/00

[52] U.S. Cl. ..... 118/410; 118/DIG. 4

[58] Field of Search ..... 118/410, 419, 411, 412, 118/324–325; 425/461

[56] References Cited

U.S. PATENT DOCUMENTS

| | | | |
|---|---|---|---|
| 1,643,657 | 9/1927 | Heisel . | |
| 2,754,544 | 7/1956 | Bicher, Jr. | 18/15 |
| 2,761,417 | 9/1956 | Russell | 118/410 |
| 2,761,791 | 9/1956 | Russell | 117/34 |
| 2,923,971 | 2/1960 | Nelson | 18/12 |
| 3,870,454 | 3/1975 | Penrod | 425/466 |
| 4,057,385 | 11/1977 | Yazaki et al. | 425/466 |
| 4,229,186 | 10/1980 | Wilson | 51/297 |
| 4,293,517 | 10/1981 | Knox | 425/461 |
| 4,389,181 | 6/1983 | Frick | 425/461 |
| 4,977,852 | 12/1990 | Ishizaka | 118/410 |
| 5,099,786 | 3/1992 | Shibata et al. | 118/410 |

FOREIGN PATENT DOCUMENTS

| | | |
|---|---|---|
| FR-A-2270,952 | 9/1969 | France . |
| EPA-0484980 | 5/1992 | EPO . |
| EPA-0530751 | 3/1993 | EPO . |
| DE-A-1504354 | 9/1969 | Germany . |
| 1389074 | 4/1975 | United Kingdom . |

OTHER PUBLICATIONS

E. W. Veazey and N. Barrera, "Barrier Screw Performance at Several Blown Film Die gaps", 1987.

Research Disclosure 17533 "Slide hoppers for use in coating liquid compositions".

*Primary Examiner*—W. Gary Jones
*Assistant Examiner*—Brenda Adele Lamb
*Attorney, Agent, or Firm*—Carl F. Ruoff

[57] ABSTRACT

The present invention describes slot inserts for use in a coating hopper having at least one metering slot. The slot inserts allow widthwise adjustment of the coating width. The slot inserts push fit into the metering slot and are held by friction between the walls of the metering slot. In one aspect of the invention, the inserts have different widthwise dimensions at each end allowing control over the edges. For dual cavity hoppers, the slot inserts can be shaped so as to prevent stagnant regions within the hopper cavities.

12 Claims, 2 Drawing Sheets

COATING HOPPER INSERTS

FIELD OF THE INVENTION

The present invention relates to coating a moving web with one or more layers of a liquid material. More particularly, the present invention concerns inserts for coating hoppers, which allows for quick changeover from one coating operation to another coating operation.

BACKGROUND OF THE INVENTION

Multiple slot coating hoppers are known in the art, first being described in the patents of T. A. Russell (U.S. Pat. Nos. 2,761,791 2,761,417). Shown in these patents are hoppers which contain multiple precision metering slots, formed between adjoining plates, for the purpose of simultaneously delivering multiple layers of fluid in large widths, while maintaining uniform thickness of those layers across their width.

More recent art, British Patent 1,389,074 has disclosed that within the coating hopper there may be more than one distribution channel, or cavity, and more than one metering slot used to evenly distribute each fluid layer.

In manufacturing photosensitive products many demands may be placed upon the coating hopper. It is very important that the coating hopper be able to coat many different photographic products. This demands that it be easy, quick, simple, and efficient to changeover from coating one product to coating the next. Additionally, in coating many different products it is important that it be simple to change the width of the metering slots, and hence the coating, to meet the coating width needs of each product. Moreover, it is important that the hopper meet all these demands while maintaining a high level of quality in the coatings. Specifically this means that the width wise uniformity of the small metering slot be maintained. Also this means that it must be possible and easy to clean the entire hopper between products including removing any dirt or particles from the interior spaces of the hopper. These last considerations are important to prevent any contamination between the coating fluids of successive products and to prevent any defects in the coating.

There are several pieces of prior art which provide partial solutions to these multiple needs. U.S. Pat. No. 1,643,643 shows a mechanism installed in the head box slot of a paper mill machine. Although this mechanism provides the ability to adjust the width of the metering slot, it does not provide the ability to fully clean the interior of the hopper without disassembly. There are stagnant spaces behind this mechanism, and it would require taking the hopper apart to fully clean the interior. This does not meet the demand of product changeover efficiency as described above.

Alternatively, in U.S. Pat. No. 2,923,971 provides a description of inserts within the distribution cavity in order to prevent stagnant spaces. This feature may be helpful in preventing the accumulation of fluid, the settling of particles, and may aid in cleaning between products. However, this patent shows no means of changing the metering widths of the fluids to meet individual product coating widths.

U.S. Pat. Nos. 3,870,454 and 4,057,385, describe adjustable deckle blades in extrusion hoppers for the purpose of adjusting the width while preventing leakage past the deckles. These deckle blades are lacking in that they are not easily removable for cleaning between products leaving a severe quality and contamination concern.

SUMMARY OF THE INVENTION

The present invention solves the above mentioned problems in a novel manner. The present invention includes slot inserts adapted for use in a coating hopper having at least one metering slot bounded by a first and second wall. The slot inserts have a thickness equal to or less than the thickness of the metering slot. The slot inserts are securely positioned within the metering slot by friction between the slot insert and the first and second walls of the metering slot. This configuration allows quick change of the width of the metering slot.

In an alternate embodiment for dual cavity hoppers, the slot insert of the present invention is notched such that flow from the inner cavity to the outer cavity is prevented over a portion of the width but allowed at the ends of the hopper. This embodiment allows for widthwise adjustment of the coating width while preventing stagnation regions within the hopper.

In yet another embodiment of the present invention the widthwise dimension of slot insert at one end is different from the widthwise dimension at the other end. This configuration allows adjustment of the widthwise dimension of the metering slot while providing control over the edges of coating.

For a better understanding of the present invention together with other objects, advantages and capabilities thereof, reference is made to the following description and appended claims in connection with the above described drawing.

DESCRIPTION OF THE PREFERRED EMBODIMENT

Figure 1:
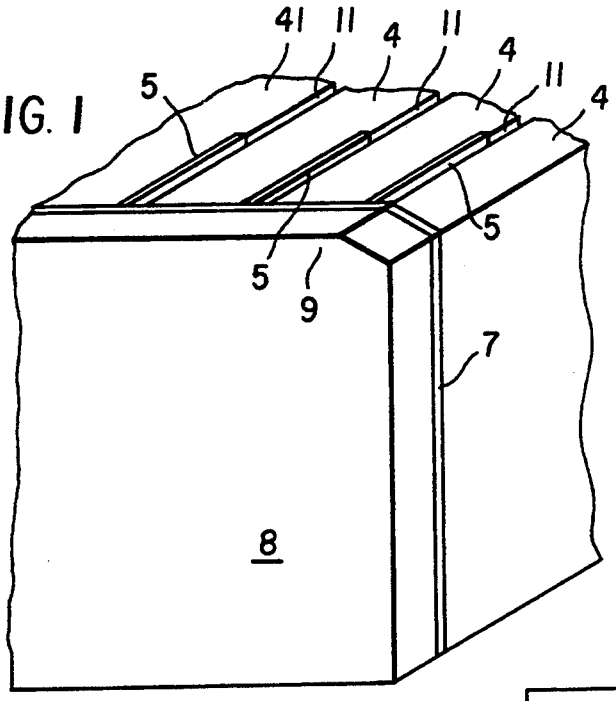
FIG. 1 shows a fragmenting perspective view of a hopper including the push fit inserts of the present invention.
Figure 2:
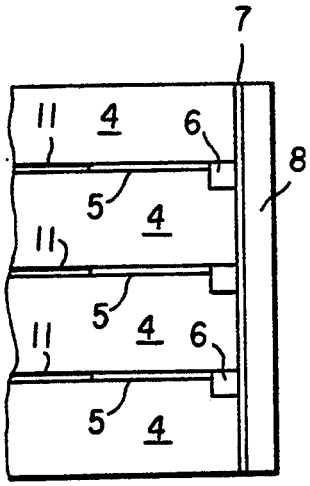
FIG. 2 shows a top view of a hopper including the push fit inserts of the present invention.

FIGS. 1 and 2 show a side and a top view of a coating hopper containing slot inserts. The hopper is comprised of adjoining hopper elements 4. The hopper elements 4 fit together in a manner to create metering slots 11 through which the liquid to be coated flows. The end of the hopper is sealed by an end seal 6, a one piece rubber end gasket 7 and a one piece end plate 8. An end seal 6 is not required in certain hopper types. The slot inserts 5 are cut to a precise length and width and placed into and at the ends of the metering slots 11 from the top of the hopper. The one-piece end gasket 7 serves to seal along the top edge of the adjoining hopper elements 4. The one piece end plate has a raised wall feature 9 to prevent any emulsion overflow from the slide surface.

Figure 3:
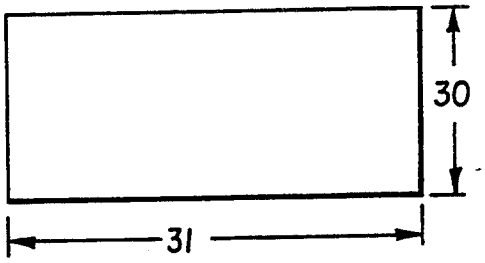
FIG. 3 shows a side view of a hopper insert.
Figure 4:
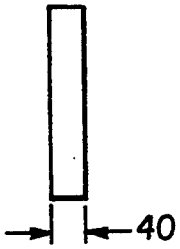
FIG. 4 shows an end view of a hopper insert.

The push fit inserts are shown from the side and the end in FIGS. 3 and 4 respectively. The insert can be made of many materials, including plastic, metal, or paper. Plastic insert material is easily obtained in precise thicknesses and is amenable to custom cutting for width. In a preferred embodiment the insert shown in FIG. 4 has a thickness approximately 1–10% thinner than the room temperature thickness of the metering slot.

Figure 5:
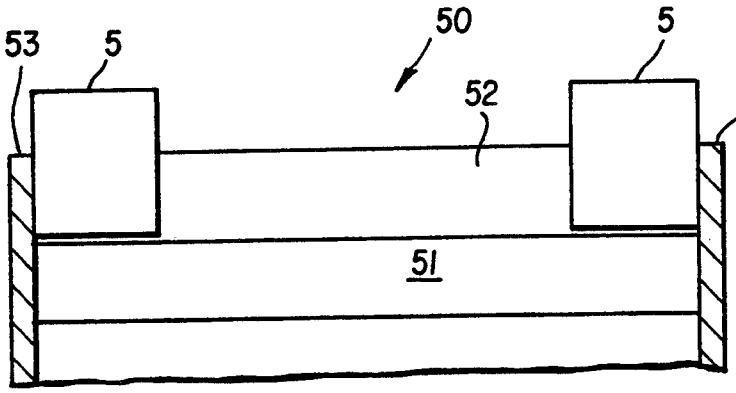
FIG. 5 shows a sectional view of a single distribution cavity hopper in which slot inserts of the present invention are positioned.
Figure 6:
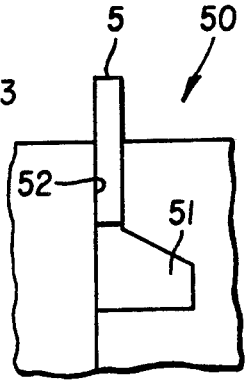
FIG. 6 shows an end view of a single distribution cavity of a hopper in which slot inserts of the present invention are inserted.

FIG. 5 shows a sectional view of a single distribution cavity hopper containing the slot inserts of the present invention. The hopper 50 includes a distribution cavity 51 and a metering slot 52. The ends of the hopper 50 are sealed by end plates 53 and sealing gaskets (not shown). The hopper inserts 5 are inserted into the metering slot 52 to precisely control the coating width of the coating solution. At the completion of a product coating, the slot inserts 5 are simply and quickly pulled out of the metering slots 52. These inserts may be saved for future use or discarded. The cleaning of the exterior and interior of the hopper including the distribution cavity and the metering slot proceeds with no slot inserts in place. After cleaning, inserts for the next product coating which have been previously customized are inserted into the metering slots. These are installed by being pushed into the metering slots from the outside of the hopper. No disassembly of the hopper is required in the cleaning and reinstallation procedure. The new inserts are held in place by their friction with the side walls of the metering slots. FIG. 6 shows a side view of the single distribution cavity hopper containing the slot inserts of the present invention.

The slot inserts of the present invention also act in several ways to provide quality improvement in the coatings. It has been found that the slot inserts have no effect on the critical metering slot dimensions. This is because the slot dimension is determined by the structure of the hopper, which is far more robust than the slot insert. Moreover, in a multiple slot hopper, any forces created by one slot insert are countered by forces from a neighboring slot insert.

Figure 7:
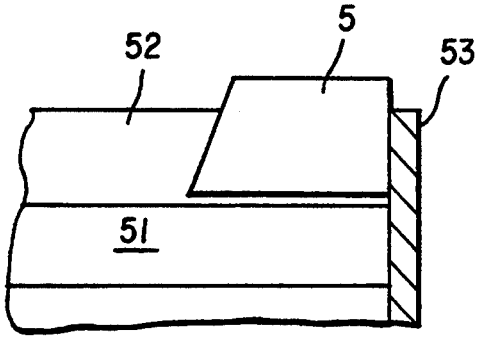
FIG. 7 shows a sectional view of a single distribution cavity hopper having a slot insert of the present invention.
Figure 8:
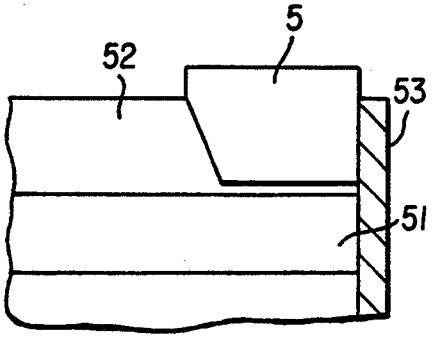
FIG. 8 shows a sectional view of a hopper having a slot insert of the present invention.

Shown in FIGS. 7 and 8 are alternate embodiments of the slot inserts of the present invention. As shown in these figures, the edge of the slot insert 5 in contact with the coating fluid can be angled either inward toward the center of the hopper or outward away from the center of the hopper. These customizations allow control over the quality of the edge of the coating.

Figure 9:
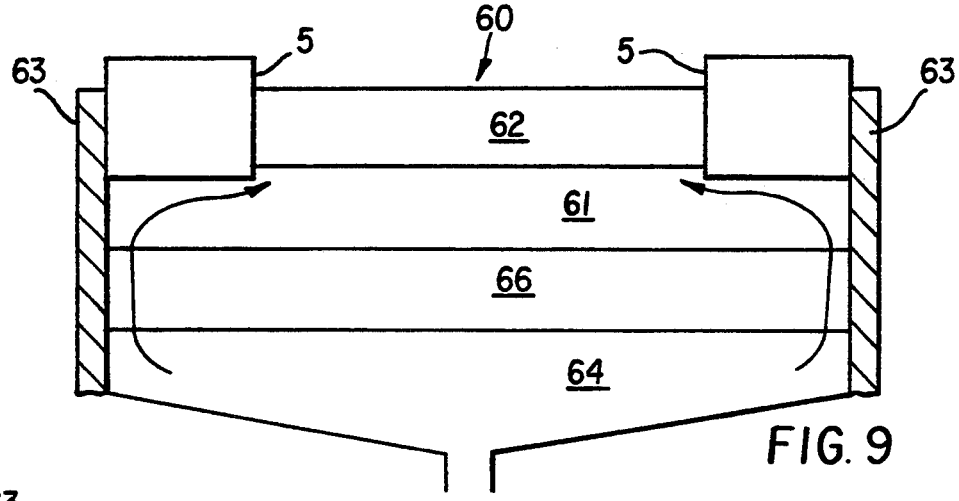
FIG. 9 shows a sectional view of a dual cavity hopper having a slot insert of the present invention.
Figure 10:
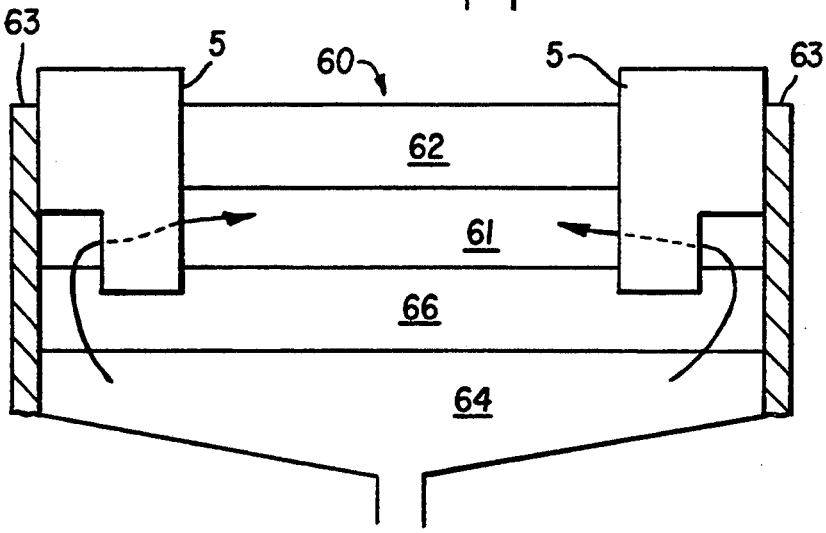
FIG. 10 shows a sectional view of a dual cavity hopper having a slot insert of the present invention.

A further advantage of the present invention is shown in FIGS. 9 and 10 wherein the slot inserts are inserted into dual cavity hoppers. Coating solutions which are stagnant within coating hoppers are a problem because gelatin or other particles can collect and become hard to clean out. This gelatin or other particles can cause streaks if it reenters and disturbs the coating flow. Stagnant flow can occur at the ends of any inner cavity whose cross sectional area does not taper to zero. Additionally, stagnant flow occurs in any hopper in which the coating width is made narrower than the width of the cavities by using slot inserts. In this case the stagnation occurs not only in the inner cavity but in the outer cavity as well.

Shown in FIG. 9 is an example of allowing a small circulation of flow from a dual cavity hopper. The dual cavity hopper contains a metering slot 62 through which coating fluid flows to the slide surface. The outer slot 62 is in fluid communication with the outer cavity 61. The outer cavity is in fluid communication with the inner cavity 64 through communication slot 66. The ends of the hopper 60 are sealed by end plates 63 and gaskets not shown. FIG. 9 shows a small circulation of flow from the inner cavity 64 into the outer cavity 61 by using an insert 5 which does obstruct the inner slot 66. The coating width is unchanged but the ends of the cavity are free of stagnation regions. This can be applied to any dual cavity hopper geometry, from constant area to tapered.

Figure 11:
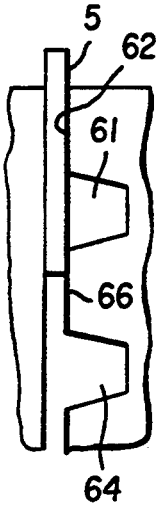
FIG. 11 shows a side view of a dual cavity hopper having a slot insert of the present invention.

FIG. 10 shows another example for preventing stagnation within a dual cavity hopper. In this example the slot insert 5 is notched at either end of the hopper 60. The slot insert extends through the metering slot 62. The notched portion of the slot insert extends partially into the outer cavity 61 while the other portion of the slot insert extends through the outer cavity 61 and partially into the communication slot 66. In this way the amount of flow between the cavities can be controlled independently of the coating width. The flow at the edges of the hopper is shown by the arrows. A side view is presented in FIG. 11.

The advantages of the slot insert of the present invention are that it allows for both productive and high quality use of coating hoppers in an environment where more than one product is coated from the same hopper. Specifically, the slot insert allows rapid product changeovers, customization for each product, integrity of the critical metering slot dimension, control over the coating edge, and efficient cleaning of the interior of the hopper. All of these performance features are achieved without any disassembly of the hopper. In addition, the slot inserts of the present invention eliminate stagnation in dual cavities hoppers while varying coating widths out of the outer cavity. The flow from the inner to the outer cavities using the slot inserts of the present invention is driven naturally by the higher pressure of the inner cavity. Additionally, this technology is compact and simple, requiring no external plumbing or pumps.

While there has been shown and described what are at present considered the preferred embodiments of the invention, it will be obvious to those skilled in the art the various alterations and modifications may be made therein without departing from the scope of the invention.

We claim:

1. An apparatus comprising a coating hopper having at least one metering slot bounded by a first wall and second wall, the slot having a first width; and one or more inserts having a second width less than the first width and a thickness less than or equal to the distance between the first and second wall, the insert insertable and removable from the metering slot without coating hopper disassembly wherein when the insert is inserted in the metering slot the insert is securely held by friction between the insert and the first and second wall bounding the metering slot, so that the metering slot's width is determined by the second width of said one or more inserts and the first width of the metering slot.

2. The apparatus according to claim 1 wherein the thickness of said one or more inserts is approximately 90% to about 99% of the distance between the first and second wall bounding the metering slot.

3. The apparatus according to claim 1 wherein said one or more inserts are made of a material which is softer than the first and second wall.

4. The apparatus according to claim 3 wherein the material is plastic.

5. An apparatus comprising a coating hopper having a first cavity and second cavity in fluid communication through a communication slot and a metering slot in fluid communication with second cavity, the metering slot being bounded by a first wall and second wall, the slot having a first width; and one or more inserts having a second width less than the first width and a thickness less than or equal to the distance between the first and second wall, the insert insertable and removable from the metering slot without coating hopper disassembly, wherein when the insert is inserted in the metering slot the insert is securely held by friction between the first and second wall bounding the metering slot, so that the metering slot's width is determined by the second width of said one or more inserts and the first width of the metering slot, said one or more inserts having a first length such that when placed in the metering slot a first portion of one or more inserts extends into the communication slot so that flow from the inner cavity to the outer cavity is blocked for a first portion of the width and said one or more inserts having a second length such that when placed in the metering slot a second portion of the insert does not extend into the communication slot so that flow between the inner cavity and the outer cavity occurs thereby preventing stagnation in the inner cavity.

6. The apparatus according to claim 5 wherein the thickness of said one or more inserts is approximately 90% to about 99% of the distance between the first and second wall bounding the metering slot.

7. The apparatus according to claim 5 wherein the insert is made of a material softer than the first and second wall.

8. The apparatus according to claim 7 wherein the material is plastic.

9. An apparatus comprising a coating hopper having at least one metering slot bounded by a first wall and second wall, the slot having a first width; and one or more inserts having a second width less than the first width and a thickness less than or equal to the distance between the first and second wall, the insert insertable and removable from the metering slot without coating hopper disassembly, wherein when the insert is inserted in the metering slot the insert is securely held by friction between the first and second wall bounding the metering slot, so that the metering slot's width is determined by the second width of said one or more inserts and the first width of the metering slot, said one or more inserts having a first widthwise dimension at first end and a second widthwise dimension at a second end said first and second widthwise dimensions being unequal.

10. The apparatus according to claim 9 wherein the thickness of said one or more inserts is approximately 90% to about 99% of the distance between the first and second wall bounding the metering slot.

11. The apparatus according to claim 9 wherein said one or more inserts are made of a material which is softer than the first and second wall.

12. The apparatus according to claim 11 wherein the material is plastic.

* * * * *